US005984844A

United States Patent [19]

Royer

[11] Patent Number: 5,984,844

[45] Date of Patent: Nov. 16, 1999

[54] PORTABLE EXERCISE DEVICE

[76] Inventor: Marc A. Royer, 1860 Phillippi Shores Dr. #8-A, Sarasota, Fla. 34231

[21] Appl. No.: 09/176,159

[22] Filed: Oct. 21, 1998

[51] Int. Cl.[6] ..... A63B 21/00

[52] U.S. Cl. ..... 482/133; 482/131; 482/121; 482/122

[58] Field of Search ..... 482/122, 121, 482/114, 123, 124, 125, 904

[56] References Cited

U.S. PATENT DOCUMENTS

| | | | |
|---|---|---|---|
| 332,989 | 12/1885 | Benedict | 482/102 |
| 2,220,593 | 11/1940 | Watson | 272/57 |
| 2,843,858 | 7/1958 | Bjorklund . | |
| 4,174,832 | 11/1979 | Thompson | 272/133 |
| 4,602,618 | 7/1986 | Barzé . | |
| 4,637,607 | 1/1987 | McArthur | 272/132 |
| 4,928,958 | 5/1990 | Sabin | 272/96 |
| 5,171,295 | 12/1992 | Schwalm, Jr. . | |
| 5,303,716 | 4/1994 | Mason et al. . | |
| 5,505,681 | 4/1996 | Bruggemann . | |
| 5,795,274 | 8/1998 | Kasbohm | 482/115 |
| 5,820,519 | 10/1998 | Slenker | 482/4 |

*Primary Examiner*—Richard J. Apley
*Assistant Examiner*—Lori L. Baker-Smith
*Attorney, Agent, or Firm*—Kenneth L Tolar

[57] ABSTRACT

An exercise assembly includes a hollow, substantially rectangular housing having a pair of side walls, a rear wall, an openable front wall and an open top in communication with an interior chamber. A cord encompasses a pulley system inside the interior chamber and exits the housing at its open top. The side and rear walls each have a pair of aligned rows of apertures for receiving an anchoring assembly. The anchoring assembly includes two outwardly extending legs which may be placed beneath a furniture item to stabilize the device while a user performs a desired exercise.

9 Claims, 3 Drawing Sheets

PORTABLE EXERCISE DEVICE

BACKGROUND OF THE INVENTION

The present invention relates to a versatile and portable exercise device which may be conveniently secured to any one of a plurality of furniture items.

DESCRIPTION OF THE PRIOR ART

Many conventional exercise devices that exist in the prior art employ weights and similar cumbersome resistance means which are difficult to transport. Although various pulley type portable exercise assemblies exist, most of these devices must be attached to furniture or a wall using complicated and often unreliable attachment means. Furthermore, conventional muscle training devices include resistance adjustable mechanisms that are designed for intense strength training. Finally, stationary objects, such as furniture, door knobs and similar objects, to which the conventional items are typically secured often have varying dimensions and configurations. Accordingly, when a user travels, the design of the conventional device may not be attachable to the available furniture items.

The present invention provides a uniquely configured exercise device which may be conveniently anchored with a bed, chair or similar furniture item regardless of the furniture's size or configuration. Also, the exercise device includes a plurality of elastomeric cords each providing a select resistance allowing a user to selectively vary the intensity of a given exercise. Accordingly, healthy persons as wells as the elderly, the handicapped, children and similar physically challenged persons can engage in strength training without resorting to conventional strenuous methods.

Various exercise assemblies exist in the prior art. For example, U.S. Pat. No. 5,505,681 issued to Bruggemann relates to an exercise device comprising a pulley mechanism molded to a cylindrical enclosure. A force selector assembly is connected to the enclosure which also holds the device in a fixed location.

U.S. Pat. No. 5,303,716 issued to Mason et al. discloses a portable rehabilitation device comprising a pair of leg cuffs attached to lines having a handle at a distal end. The pulley mechanism is attached to a tubular base frame that freely rests on a support surface.

U.S. Pat No. 5,171,295 issued to Schwalm, Jr. discloses a pulley exercise device comprising an elongated bar having a line, handle and pulley mechanism at each end. The bar may be anchored beneath a stationary object such as a user's feet.

U.S. Pat. No. 4,928,958 issued to Sabin discloses a pulley exercise device comprising a support frame having a first and second leg which are pivotally connected. A cylinder is connected to the first and second legs for providing resistance when one leg is moved towards the other.

U.S. Pat. No. 4,602,618 issued to Berze relates to a continuous hip joint motion machine comprising a traction frame overlaying a patient's bed, a leg cradle suspended therefrom and power drive tensile elements connected to the leg cradle.

U.S. Pat. No. 2,843,858 issued to Bjorklund discloses a lift strap exerciser for attaching to the foot of a bed which may be used by a recumbent person to raise himself to a sitting position.

Each of the above described devices has several disadvantages. The devices each include a plurality of interrelated components that are expensive to manufacture and complicated to use. Furthermore, none of the devices provide a convenient, easy to use anchoring assembly according to the present invention. Finally, the conventional devices are not designed to be attachable to furniture items having various heights and configurations according to the present invention.

SUMMARY OF THE INVENTION

The present invention relates to a portable exercise device comprising a hollow, substantially rectangular base component having a pair of side walls, a rear wall and a front wall. The front wall is openable providing selective access to an interior chamber. The base component further includes an open top in communication with the interior chamber having a plurality of rollers disposed adjacent thereto that guide a cord into and out of the chamber. The cord encompasses a plurality of pulleys within the interior chamber that also guide the cord as it is reciprocated. The side and rear walls each include a pair of opposing rows of aligned apertures thereon for removably receiving a platform having a pair of legs extending outwardly therefrom. Accordingly, the platform may be positioned at a select location on the base component to secure the legs and platform beneath a weighted object having a predetermined height or width. When the device is not in use, the platform may be removed allowing the device to be compactly stored. It is therefore an object of the present invention to provide an exercise assembly that is easy to use and inexpensive to manufacture.

It is yet another object of the present invention to provide an exercise assembly which may be quickly and conveniently anchored beneath stationary items having various dimensions.

It is yet another object of the present invention to provide a portable exercise device designed for the elderly, children, those with injuries and similar persons who wish to engage in low intensity strength training.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
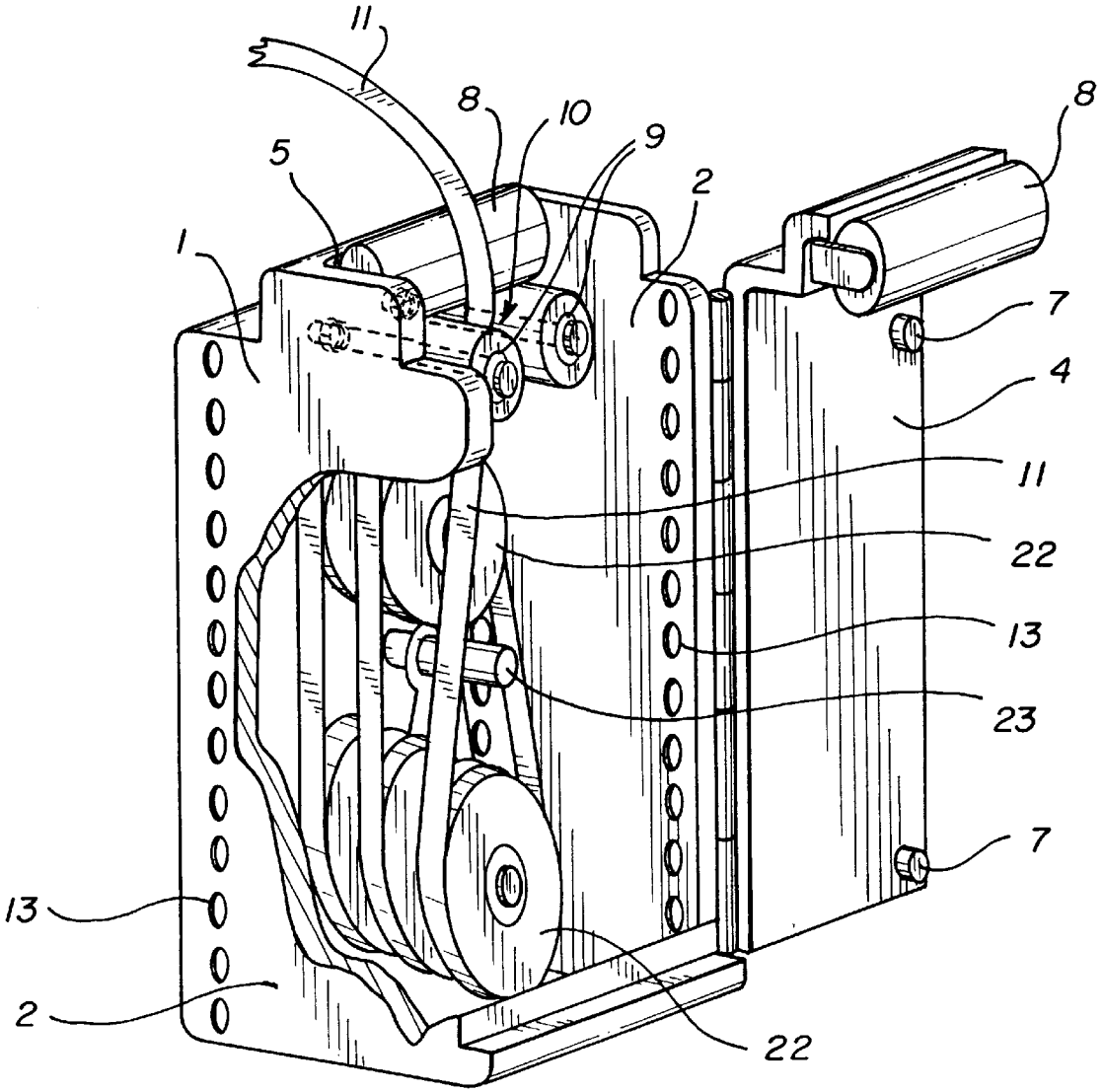
FIG. 1 is a perspective view of the inventive device with the front wall in an open position.
Figure 3:
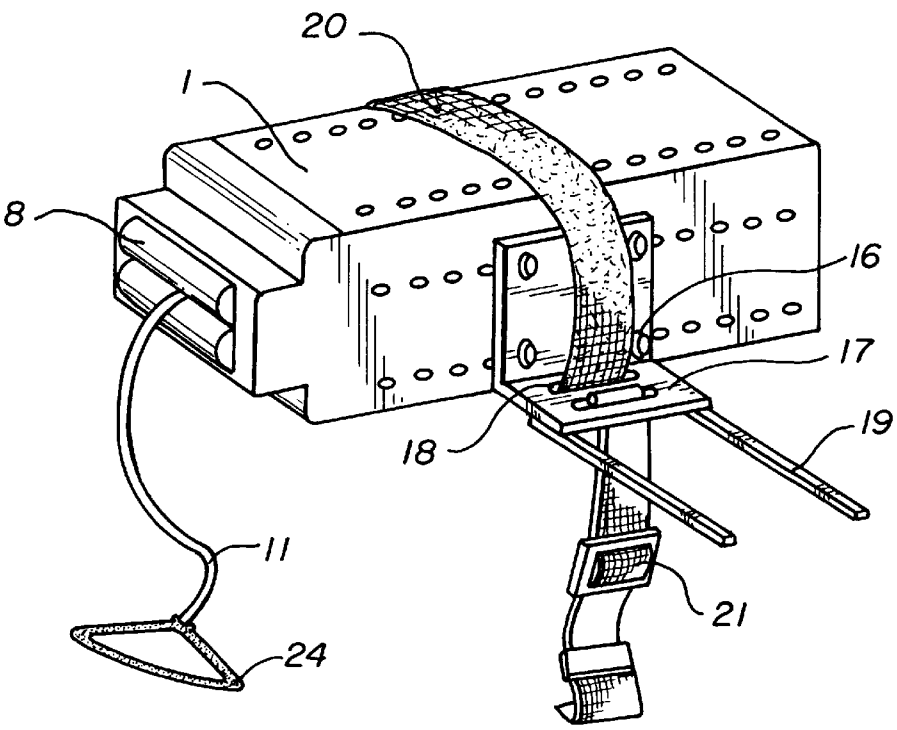
FIG. 3 depicts the inventive device for use in a horizontal position.
Figure 2:
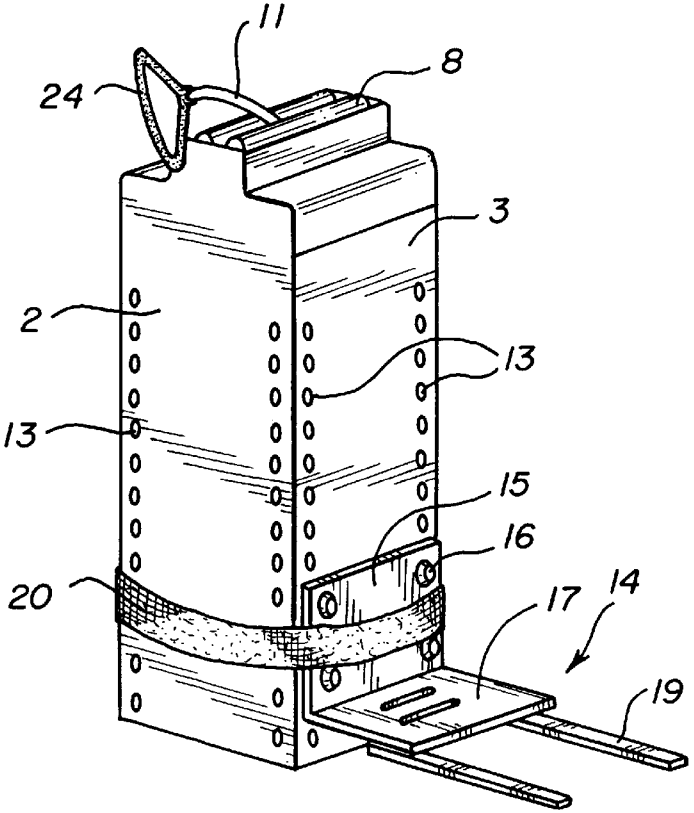
FIG. 2 is a perspective view of the inventive device with the front panel in a closed position.
Figure 5:
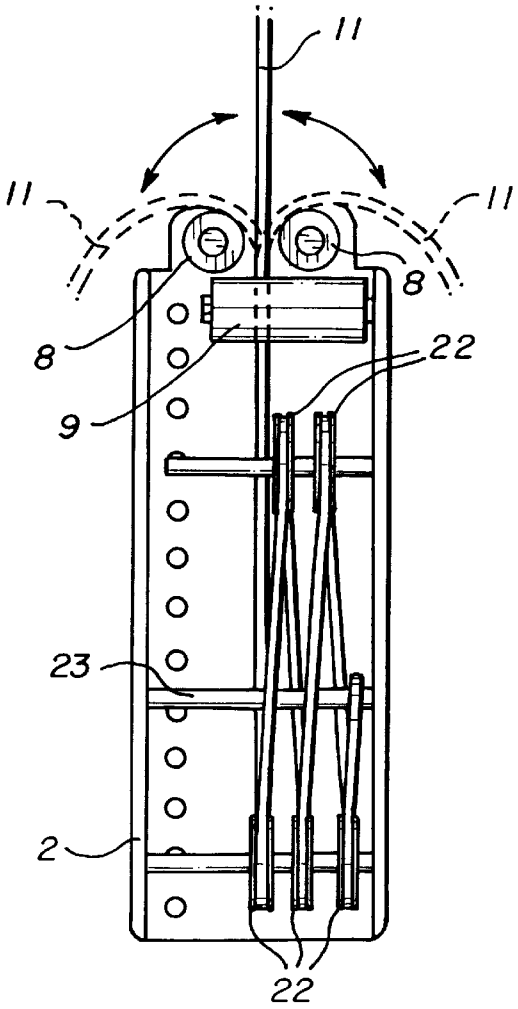
FIG. 5 is a side view of the inventive device depicting the internal components therein.
Figure 4:
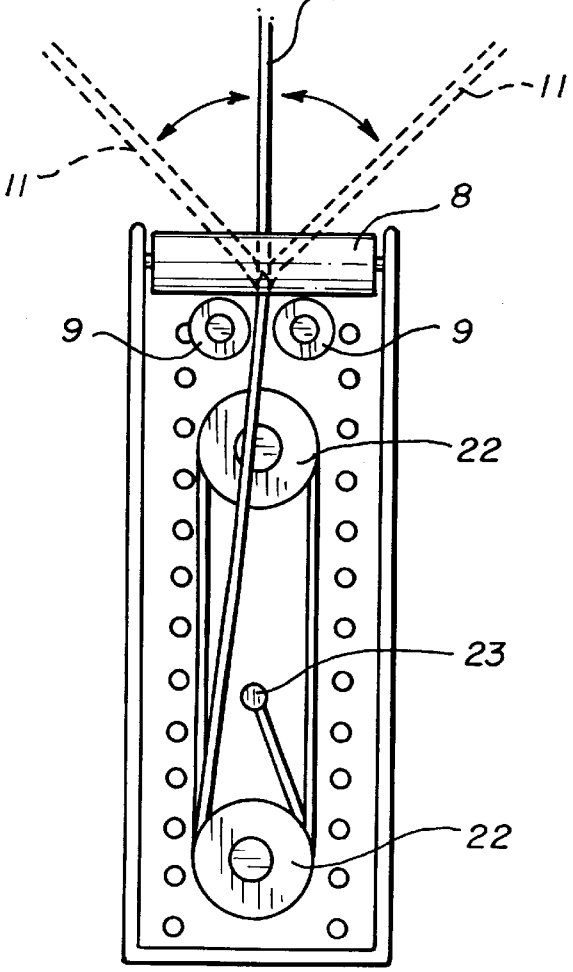
FIG. 4 is a front view of the inventive device with the front panel in an open position.

Referring now to FIGS. 1 through 5, the present invention relates to a portable exercise assembly. The device comprises a substantially rectangular hollow housing 1 having a pair of opposing side walls 2, a rear wall 3 and a front wall 4. The housing further includes an open top 5 in communication with an interior chamber. An edge of the front wall hingedly engages a longitudinal edge of a side wall and is pivotable between an open and closed position to provide selective access to the interior chamber. Although the front panel is depicted and described as hinged and pivotable, any type of movable panel may be used to provide selective access to the housing interior chamber. For example, the front panel may be slidably received within grooves on the housing. Any other similar, equivalent construction may also be used. Adjacent the opposing edge of the front wall on its inwardly facing side are a plurality of ports 7 for receiving a fastener means to secure the front wall to the opposing side wall when in a closed position.

Disposed within the open end are a plurality of rollers including a pair of upper rollers 8, substantially parallel to the front and rear walls and a pair of lower rollers 9 superimposed thereon that are substantially parallel to the side walls. The upper and lower rollers form a central passageway 10 for guiding a cord 11 as said cord is extended into and out of the interior chamber as will be described in more detail below. One of the upper rollers is secured to the top edge of the front wall allowing the cord to be easily replaced when the front panel is opened.

The side and rear walls each have two opposing rows of aligned apertures 13, each row adjacent a longitudinal edge thereof for removably receiving an anchoring assembly 14. The anchoring assembly includes a panel 15 having a plurality of projections 16 extending from a side thereof that are spaced to be simultaneously inserted within a select group of apertures on the rear or side walls of the housing. Perpendicularly extending from the opposing side of the panel adjacent an edge thereof is a platform 17 having a pair of slots 18 therethrough. Attached to the bottom surface of the platform and extending from a side opposite the panel are a pair of legs 19 for assisting a user in inserting the platform beneath a stationary object such as a mattress, chair or similar furniture item to anchor the device when a user is performing a desired exercise. Accordingly, the anchoring assembly may be selectively positioned on the housing depending upon the size or configuration of the stationary object or the exercise to be performed.

A first strap 20 may be received within one of the platform slots and wrapped about the panel and the base component to further secure the anchoring assembly thereto. The strap may include Velcro® portions adjacent each end or a similar attachment means to secure the strap about the housing. A second, length adjustable strap 21 is received within the second slot to further secure the anchoring assembly to a stationary object if necessary.

Received within the interior chamber are a plurality of pulleys 22 that are encompassed by the cord. A first end of the cord is secured to a transverse rod 23 received within the housing interior chamber. The opposing end extends from the top of the housing through the roller assembly and has a handle member 24 at a distal end. A bar or harness may also be provided to allow a user to perform a variety of exercises. The cord is preferably made from a resilient but flexible material such as that commonly referred to as a Bunge™ cord. Accordingly, a user may grasp the handle and perform a given exercise by stretching the cord a predetermined distance and then returning the cord to its original position.

The above described device is designed to be used in pairs, each for a designated limb allowing two limbs to be exercised simultaneously. Preferably, a plurality of cords are provided each having a select tension so that a user may selectively vary the resistance of a given exercise. The above described design allows the cord to be quickly and conveniently replaced when the user wishes to vary the resistance. The housing is preferably constructed with aluminum, steel, or plastic. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An exercise assembly comprising:

a hollow housing having a front wall, a pair of opposing side walls, a rear wall and an open top in communication with an interior chamber;

an anchoring means selectively positionable on the side and rear walls of said housing for securing said housing to a stationary object having a predetermined configuration;

an elastomeric cord encompassing a pulley assembly within said housing with a first end of said cord extending through said open top having a handle attached thereto with a second end secured within said housing whereby a user may grasp said handle and pull said cord to perform a given exercise.

2. A device according to claim 1 wherein said front wall is movable between an open and closed position to allow selective access to the housing interior chamber.

3. A device according to claim 1 further comprising:

a strap removably attachable to said anchoring assembly to further secure said anchoring assembly to said housing.

4. A device according to claim 1 wherein said side and rear walls further include a pair of opposing rows of aligned apertures.

5. A device according to claim 4 wherein said anchoring means comprises:

a panel having two opposing surfaces with a plurality of projections extending from a first surface, said projections removably insertable into a select number of apertures on said housing walls;

a platform perpendicularly extending from the opposing surface of said panel having a pair of legs extending therefrom for inserting said platform beneath a stationary, weighted object.

6. A device according to claim 1 further comprising a pair of lower rollers received within said housing interior chamber and disposed adjacent the top end;

a pair of upper rollers superimposed on said upper rollers and substantially perpendicular thereto, said upper and lower rollers defining a passageway through which said cord is guided into and out of said housing.

7. A device according to claim 5 wherein said panel further includes a first slot for receiving a length adjustable strap to further secure said housing to a stationary object.

8. A device according to claim 6 wherein a first upper roller is attached to an inwardly facing side of said front wall to allow said cord to be easily separated from said rollers when said front wall is pivoted to an open position.

9. A device according to claim 5 wherein said panel further includes a second slot for receiving a second strap to secure said panel to said housing.

* * * * *